US005137381A

United States Patent [19]

Stempfle et al.

[11] Patent Number: 5,137,381

[45] Date of Patent: Aug. 11, 1992

[54] MATRIX PIN PRINT HEAD

[75] Inventors: Johann Stempfle, Pfaffenhofen; Bernd Gugel, Ulm-Einsingen, both of Fed. Rep. of Germany

[73] Assignee: Mannesmann Aktiengeselschaft, Düsseldorf, Fed. Rep. of Germany

[21] Appl. No.: 718,030

[22] Filed: Jun. 20, 1991

[30] Foreign Application Priority Data

Jun. 20, 1990 [DE] Fed. Rep. of Germany ..... 4020015

[51] Int. Cl.[5] ..... B41J 2/23

[52] U.S. Cl. ..... 400/124; 101/93.05

[58] Field of Search ..... 400/124; 101/93.05

[56] References Cited

U.S. PATENT DOCUMENTS 4,143,979 3/1979 Boyd ..... 400/124
4,176,975 12/1979 DeBoskey ..... 400/124
4,869,605 9/1989 Kikuchi et al. ..... 400/124

FOREIGN PATENT DOCUMENTS 0057765 4/1984 Japan ..... 400/121

*Primary Examiner*—Edgar S. Burr
*Assistant Examiner*—Lynn D. Hendrickson
*Attorney, Agent, or Firm*—Horst M. Kasper

[57] ABSTRACT

In a matrix pin print head, the armatures (15*a*) of the magnet drive (12), transferring the advance motions to the print pin, rest in each case against the print pin (4). The print pin (4) and the print pin head (22) form a rigid connection. In order to reduce friction and wear, the print pin head (22) is made of a technical ceramic material at the print pin end (21) and the print pin head (22) is formed as a molded piece (23). The print pin end (21) is adhesively attached in, pressed into, or sintered into the interior of the molded piece (23). The connection length (25) between the print pin and the print pin head corresponds at to at least twice the diameter (26) of the print pin (4).

15 Claims, 2 Drawing Sheets

MATRIX PIN PRINT HEAD

BACKGROUND OF THE INVENTION

1. Field of the Invention

The invention relates to a matrix pin print head with several print pins, which can each be moved forward into print position by way of a separate magnet drive, which print pins are resting at an element of the magnet drive transferring the advance motions, and which print pins can in each case be moved backward by way of a spring force, wherein each print pin exhibits a print pin head rigidly connected to the print pin.

2. Brief Description of the Background of the Invention Including Prior Art

The connection between the print pin and the print pin head is of substantial functional and production technological importance in a matrix pin print head. Print pins are known, where the print pin head is connected to a steel ball and a half ball or a disc made of metal, which in each case are injection molded with plastic. The shape of the print pin head corresponds then to a cylinder with a ball shaped contact face resting opposite to the armature arm.

Considerations have been made to produce the print pin head without metal, without steel ball, or without half ball, and to immediately injection mold the print pin with plastic. It also would be conceivable to furnish a print pin, made of tungsten, tungsten carbide, or sintered steel, with a print pin head made of metal. Such a structure, however, would not be very wear resistant. The armature arms strike in each case onto the print pin head and the print pin head has to transfer thereby the print impact force onto the print pin. Such a arrangement results in certain wear mechanisms. A high face pressure is developed between the element, transferring the forward motion of the magnet drive such as the armature, and the print pin head. Caps, or the like, placed on a steel ball, are released by deformation. Abrasion and attrition occur between the element, transferring the advance motion, and the print pin head at the contact face and, in the course of time, a contact face is formed which is adapted to the motions. In addition, an also wear causing relative motion takes place between the element, transferring the advance motion, and the print pin head.

SUMMARY OF THE INVENTION

1. Purposes of the Invention

Is is an object of the present invention to provide a better connection structure between an armature and a print pin in a print pin head.

It is another object of the present invention to reduce the wear at print pin heads.

It is yet a further object of the invention to provide a system which results in reliable and immediate transfer of kinetic energy and momentum from an armature arm to a print pin.

These and other objects and advantages of the present invention will become evident from the description which follows.

2. Brief Description of the Invention

According to the present invention there is provided a matrix pin print head. A magnet drive includes an element for transferring an advance motion. A print pin is forward-movable in each case into a print position with the magnet drive. The print pin rests at the element of the magnet drive transferring the advance motion to the print pin. The element for transferring the advance motion contacts the print pin. Spring force means move the print pin backward by a spring force of the spring force means. A print pin head is rigidly attached to the print pin. The print pin head is formed at a print pin end and made of a technical ceramic material and is formed as a molded piece. The print pin end is fixedly connected into an interior space of the print pin head. A connection length between the print pin end and the print pin head corresponds at least to twice a diameter of the print pin.

The print pin end can be adhesively attached into, pressed into, or sintered to the interior of the print pin head.

The technical ceramic material can comprise aluminum oxide and zirconium oxide.

The element for transferring the advance motion can be an armature of the magnet drive. Two side cheeks can be disposed at the print pin head. The armature of the magnet drive can be disposed for engaging between the side cheeks. A curved support face can be formed on the print pin head between the side cheeks for a rolling off of the armature on the curved support face.

The print pin can be of cylindrical structure. The cylindrical print pin can be attached immediately in the print pin head with a front face of the print pin running perpendicular to the print pin axis.

The spring force means for the backward motion of the print pin can be formed like a leg spring. The leg spring can grip under the print pin head with a spring leg disposed toward the armature.

The leg spring can be disposed such that its bend generates a spring force directed substantially parallel to the direction of motion of the print pin.

According to the invention, the print pin head is made of a technical ceramic material at the print pin end and is formed as a molded piece. The print pin end can be adhesively attached in the interior of the molded piece. Alternatively, the print pin end can be pressed into the molded piece, or where the print pin end can be sintered into the molded piece. The connection length between print pin end and print pin head is at least two times the diameter of the print pin. Such a structure substantially decreases the wear occurring between the magnetically conducting material of the armature and the print pin head made of ceramic. It is particularly advantageous in this context that the ceramic materials can be furnished with a very dense and a very smooth surface.

According to a preferred embodiment of the invention, the ceramic material comprises aluminum oxide and zirconium oxide. The print pin head can be molded particularly advantageously as a molded piece and exhibits a high degree of hardness and a high surface quality as a prefabricated finished piece.

According to a further embodiment of the invention, the print pin head forms two side cheeks or side faces. An armature of the magnet drive engages between the two side cheeks, thereby a curved support face is formed for the armature. Such a print pin head can also advantageously be produced as a molded part while the mass of the ceramic material is still soft, and such print pin head is particularly hard and wear reducing as a prefabricated finished piece.

It is advantageous relating to production technology, that a cylindrical print pin is attached with a front face, running perpendicular to the print pin axis, immediately in the print pin head. It is taken into consideration here that the connection length between the end of the print pin and the print pin head corresponds to at least twice the diameter of the print pin such that a strong connection is generated between the print pin and the print pin head.

This fixed connection between the print pin end and the print pin head advantageously allows that the spring force for the backward motion of the print pin is formed by a leg spring. This leg spring grips under the print pin head with the spring leg disposed in each case toward a respective armature.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

DESCRIPTION OF INVENTION AND PREFERRED EMBODIMENT

Figure 1:
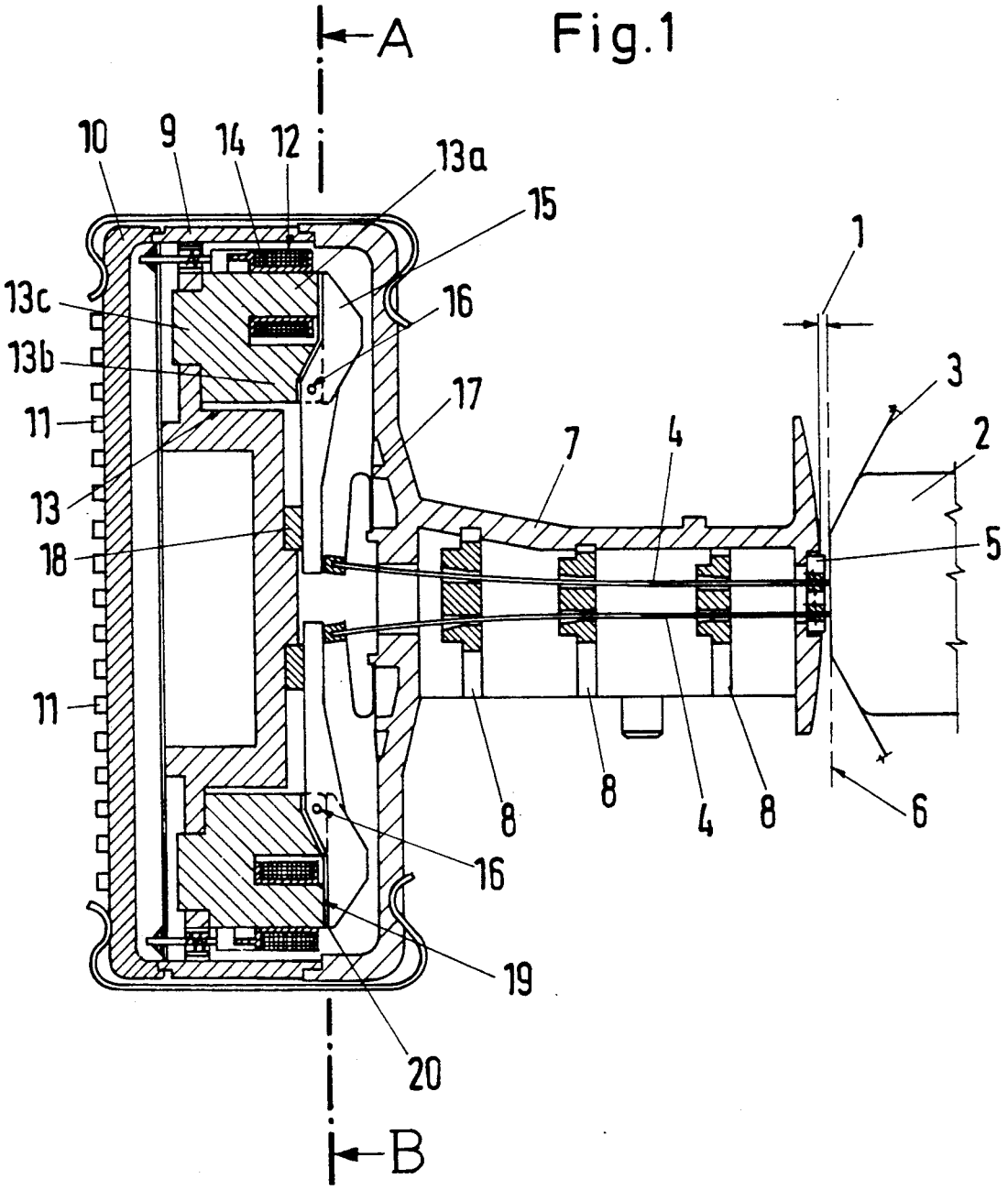
FIG. 1 is a longitudinal sectional view through a serial matrix print pin head.
Figure 2:
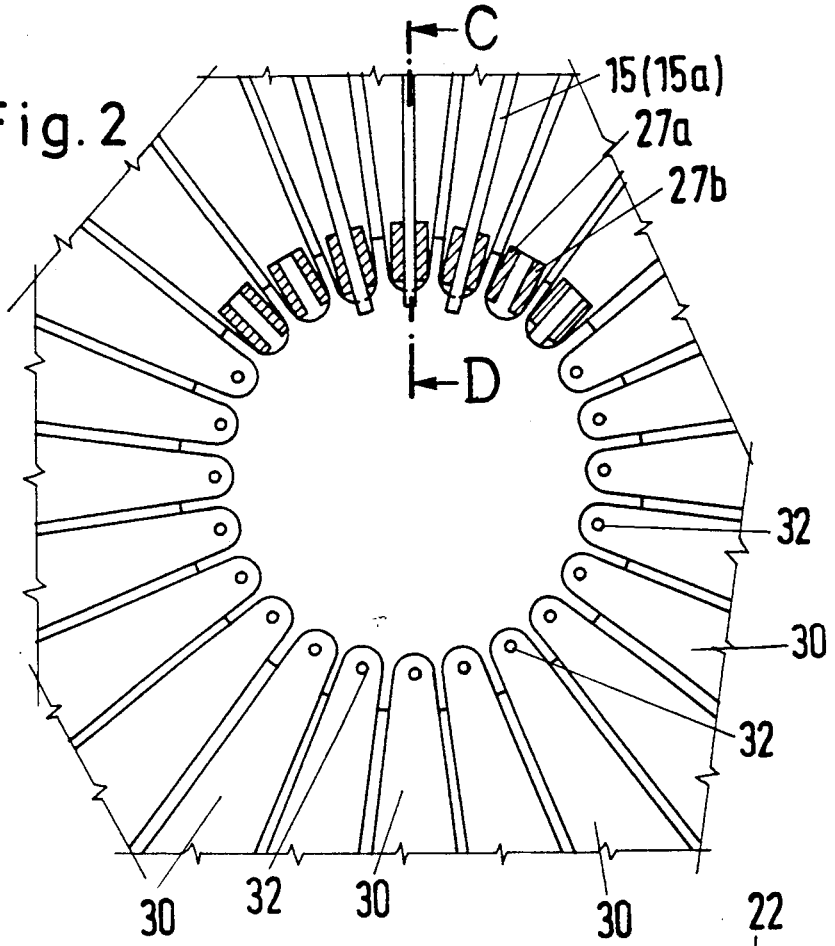
FIG. 2 is a cross-sectional view of the embodiment of FIG. 1 along section line A-B.

According to the present invention, there is provided for a matrix pin print head with several print pins 4. Said print pins 4 are forward movable in each case into a print position with a separate magnet drive 12. The print pins rest at an element 15 of the magnet drive 12 transferring the advance motions. The print pins are moved back in each case by a spring force. Each print pin 4 exhibits a print pin head 22, rigidly connected to the print pin 4. The print pin head 22 is formed at the print pin end 21 and is made of a technical ceramic material and is formed as a molded piece 23. The print pin end 21 is adhesively attached, pressed into, or sintered into the interior of the print pin head 22. The connection length 25 between the print pin end 21 and the print pin head 22 corresponds at least to twice the diameter 26 of the print pin 4.

The technical ceramic material can comprise aluminum oxide and zirconium oxide.

The print pin head 22 can form two side cheeks 27*a*, 27*b*. An armature 15*a* of the magnet drive 12 can engage between the side cheeks 27*a*, 27*b*. A curved support face 28 can be formed on the print pin head between the side cheeks for a rolling off of the armature 15*a*.

A cylindrical print pin 4 can be attached immediately in the print pin head 22 with a front face 29 running perpendicular to the print pin axis.

The spring force for the backward motion of the print pin 4 can be formed by way of a leg spring 30. The leg spring 30 can grip under the print pin head 22 with a spring leg 31 in each case disposed toward the armature 15*a*.

The matrix print head illustrated in FIG. 1 represents a serial matrix pin print head, which is disposed at pin stroke distance 1 opposite to a print substrate support 2. An imprint-receiving substrate 3 rests fully on the print substrate support 2. A continuously or discontinuously moved inking ribbon 6 is disposed in front of the imprint receiving substrate 3, i.e. between the front ends of the print pins 4. The print pins 4 are guided in a mouth piece 5. The print pins 4 form one or several vertical needle slots in the mouth piece 5 of, for example, 2×9 or 2×12 print pins. The print pins 4 are supported and guided in their totality in print pin guide casing 7 with support bearings 8. The print pins 4 run up to the area of a rearward print pin drive casing 9, which is closed by a cover 10. The cover 10 exhibits cooling ribs 11 for the discharge and dissipation of heat, which heat is generated by the magnet drives 12.

Each print pin 4 is coordinated to such a magnet drive 12 disposed in the print pin drive casing 9. The magnet drive 12 includes in each case a magnet yoke 13. Each magnet yoke 13 comprises two magnet yoke arms 13*a* and 13*b* as well as a magnet yoke foot 13*c*. An electromagnetic coil 14 is slid and shifted onto a magnet yoke arm 13*a* or 13*b*. In addition, an armature 15*a*, belongs to each magnet drive 12, where the armature 15*a* is tiltable by way of a pin support 16 and rests by way of a spring 17 in a rearward position against a stop 18. An operational air gap 20 is formed between the armature 15 and a magnet yoke arm front face 19.

Each print pin 4 supports a print pin head 22 at a rear print pin end 21, as illustrated in FIGS. 2–5. The print pin head 22 is made of a technical ceramic material and is formed as a molded piece 23. The print pin end 21 is adhesively attached in the interior 24 of the molded piece 23, alternatively, the print pin end 21 is pressed into the interior 24 of the molded piece 23 or, respectively, the print pin end 21 is sintered into the interior 24 of the molded piece 23. The connection length 25 between the print pin end 21 and the molded piece 23 corresponds to at least twice the diameter 26 of the print pin 4. The molded piece 23 is produced of ceramic material made of aluminum oxide and zirconium oxide.

Figure 3:
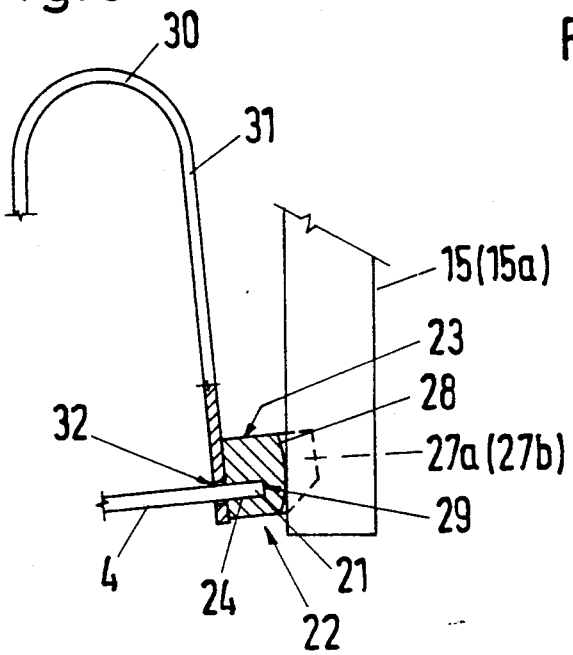
FIG. 3 is a partial sectional view of the embodiment of FIG. 2 along section line C-D.
Figure 4:
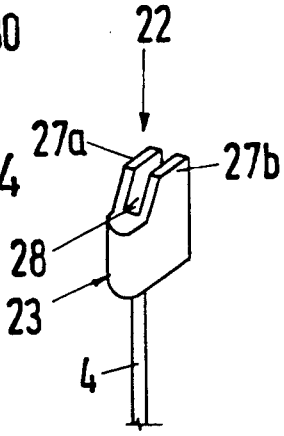
FIG. 4 is a perspective view of a first exemplified embodiment of the connection of print pin and print pin head.

According to a first embodiment illustrated in FIGS. 3 and 4, the print pin head 22 furnishes two side cheeks 27*a* and 27*b*. The two side cheeks are disposed substantially parallel to the elongation direction of the armature. The two side cheeks 27*a* and 27*b* are disposed at a distance such that the element 15, in particular the armature 15*a*, transferring the motions induced by the magnet drive, forms a lateral guide for the thickness of the armature 15*a*. A curved support face 28 is disposed between the two side cheeks 27*a* and 27*b* in order to allow independent motions of the armature 15*a* and of the print pin head 22 and in order to furnish nevertheless a continuous support. The armature 15*a* can roll off the curved support face 28. The height value of the side cheeks can be from about 0.2 to 0.5 of the extension of the pin head in pin elongation direction. The print pin end can be disposed asymmetrically in the print pin head in the half of the print pin head disposed toward the center axis of the print head. The side cheeks can be bevelled at their end toward the center axis of the print head. The armature can be structured such that its end is disposed at all times during operation at least in part between the cheeks of the print pin head.

Figure 5:
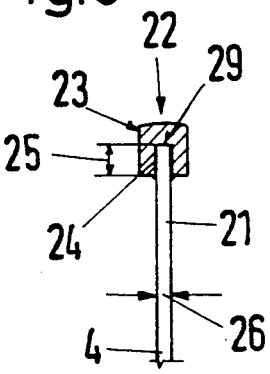
FIG. 5 is an impact sectional view of a connection between print pin and print pin head according to a second exemplified embodiment.

A cylindrical print pin 4 is attached immediately in the print pin head 22 with a front face 29 running perpendicular to the print pin axis, according to FIG. 5.

The print pin can be penetrated in the print pin head by 0.4 to 0.9 times the extension of the print pin head and preferably by from about 0.5 to 0.7 of the extension of the print pin head in longitudinal direction of the print pin.

The spring force for moving the print pin 4 back from a print position on the print substrate support 2 or, respectively, the imprint-receiving substrate 3 or, respectively, the inking ribbon 6 into a non-print rest position, as illustrated in FIG. 1, is furnished by way of leg spring 30. This leg spring grips under the print pin head 22 with a spring leg 31, respectively facing the armature 15*a*. For this purpose, the leg spring 30 is furnished with an opening hole 32 at the spring arm 31, which is correspondingly larger than the diameter 26 of the print pin 4. The diameter 26 of the print pin 4 amounts in general, for example, to 0.25 or 0.18 mm such that the opening hole 32 is correspondingly dimensioned. The diameter 26 of the print pin 4 is preferably less than 0.2 mm and less than 0.15 mm and preferably larger than 0.1 mm.

It will be understood that each of the elements described above, or two or more together, may also find a useful application in other types of print heads differing from the types described above.

While the invention has been illustrated and described as embodied in the context of a matrix pin print head with several print pins, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A matrix pin print head comprising a magnet drive;

an armature;

a print pin resting on said armature and receiving an advancing motion from said magnet drive to move said print pin from an initial position to a printing position;

a spring force means for returning said print pin to said initial position;

a print pin head rigidly attached to said print pin, said print pin head having an interior space and being made of ceramic material and formed as a molded piece;

said print pin being fixedly connected to said interior space of said print pin head, the connection length between said print pin and said print pin head being at least twice the diameter of the print pin.

2. The matrix print pin head according to claim 1, wherein a print pin end is adhesively attached into the interior space of the print pin head.

3. The matrix print pin head according to claim 1, wherein a print pin end is pressed into the interior space of the print pin head.

4. The matrix print pin head according to claim 1, wherein a print pin end is sintered to the interior space of the print pin end.

5. The matrix print pin head according to claim 1, wherein the ceramic material comprises aluminum oxide and zirconium oxide.

6. The matrix print pin head according to claim 1, wherein the print pin end is disposed asymmetrically in the print pin head in the half of the print pin head disposed toward the center axis of the print head.

7. The matrix print pin head according to claim 1, further comprising two side cheeks disposed at the print pin head, wherein the armature of the magnet drive is disposed for engaging between the side cheeks, and wherein a curved support face is formed on the print pin head between the side cheeks for a rolling off of the armature on the curved support face.

8. The matrix print pin head according to claim 1, wherein the print pin is of cylindrical structure, and wherein the cylindrical print pin is attached immediately in the print pin head with a front face of the print pin running perpendicular to the print pin axis.

9. The matrix pin print head according to claim 1, wherein the spring force means for the backward motion of the print pin is formed like a leg spring, and wherein the leg spring grips under the print pin head with a spring leg disposed toward the armature.

10. The matrix pin print head according to claim 1, wherein the leg spring is disposed such that its bend generates a spring force directed substantially parallel to the direction of motion of the print pin.

11. A matrix pin print head with several print pins and magnet drives, each of said print pins resting on an armature of one of said magnet drives for movement between an initial position and a printing position;

spring force means for returning said print pins back to said initial position;

a print pin head rigidly attached to each of said print pins, said print pin heads being formed of a ceramic material by molding;

each of said print pins being adhesively attached, pressed into, or sintered to the interior of its corresponding print pin head, with the connection length between said print pin and said print pin head being at least twice the diameter of the print pin.

12. The matrix print pin head according to claim 11, wherein the ceramic material comprises aluminum oxide and zirconium oxide.

13. The matrix print pin head according to claim 11, wherein the print pin head (22) forms two side cheeks (27*a*, 27*b*), and wherein an armature (15*a*) of the magnet drive (12) engages between the side cheeks (27*a*, 27*b*), whereby a curved support face (28) is formed on the print pin head between the side cheeks for a rolling off of the armature (15*a*).

14. The matrix print head according to claim 11, wherein a cylindrical print pin (4) is attached immediately in the print pin head (22) with a front face (29) running perpendicular to a print pin axis.

15. The matrix pin print head according to claim 11, wherein the spring force for the backward motion of the print pin (4) is formed by way of a leg spring (30), and wherein the leg spring (30) grips under the print pin head (22) with a spring leg (31) in each case disposed toward the armature (15*a*).

* * * * *